US008973913B2

(12) United States Patent
Masubuchi et al.

(10) Patent No.: US 8,973,913 B2
(45) Date of Patent: Mar. 10, 2015

(54) MEDIA CONVEYANCE DEVICE AND PRINTER

(71) Applicant: Seiko Epson Corporation, Tokyo (JP)

(72) Inventors: Hiroyuki Masubuchi, Nagano-ken (JP); Toshihiro Imae, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/178,759

(22) Filed: Feb. 12, 2014

(65) Prior Publication Data

US 2014/0252712 A1 Sep. 11, 2014

(30) Foreign Application Priority Data

Mar. 11, 2013 (JP) ..... 2013-047620

(51) Int. Cl.
*B65H 5/22* (2006.01)
*B65H 5/26* (2006.01)
*B65H 7/00* (2006.01)

(52) U.S. Cl.
CPC ... *B65H 5/26* (2013.01); *B65H 7/00* (2013.01)
USPC ..... 271/3.19; 271/3.2; 271/4.1; 271/273; 271/301; 271/65; 271/186

(58) Field of Classification Search
CPC ..... B65H 5/062; B65H 15/00; B65H 29/125; B65H 29/60; B65H 85/00
USPC ..... 271/3.19, 3.2, 4.1, 273, 301, 65, 186
See application file for complete search history.

(56) References Cited

U.S. PATENT DOCUMENTS

| | | | | |
|---|---|---|---|---|
| 2005/0099480 | A1* | 5/2005 | Saito et al. | 347/104 |
| 2011/0156336 | A1* | 6/2011 | Agata et al. | 271/3.19 |
| 2011/0241292 | A1* | 10/2011 | Griese et al. | 271/265.01 |
| 2011/0285076 | A1* | 11/2011 | Fujiwara et al. | 271/186 |
| 2011/0310444 | A1* | 12/2011 | Asada et al. | 358/498 |
| 2012/0074641 | A1 | 3/2012 | Murata | |
| 2013/0181394 | A1* | 7/2013 | Ogata et al. | 271/225 |

FOREIGN PATENT DOCUMENTS

| | | | |
|---|---|---|---|
| JP | 06-191670 | A | 7/1994 |
| JP | 2010-274580 | A | 12/2010 |
| JP | 2010-280454 | A | 12/2010 |
| JP | 2012-071918 | A | 4/2012 |

* cited by examiner

*Primary Examiner* — David H Bollinger

(57) ABSTRACT

To easily replace a retard roller (that is a media separation roller) while minimizing the required installation space, a printer 1 has a first media conveyance path 12 that conveys sheet media; a second media conveyance path 29 that conveys media and can open and close; a media conveyance roller 17 and a retard roller 16 disposed opposite each other with the first media conveyance path 12 therebetween; and a roller installation unit 70 to which the retard roller 16 is installed removably from the second media conveyance path 29 side. The retard roller 16 can be easily replaced from the open second media conveyance path 29. Compared with a configuration having a dedicated opening, a smaller opening and space for replacing the media separation roller are required.

10 Claims, 10 Drawing Sheets

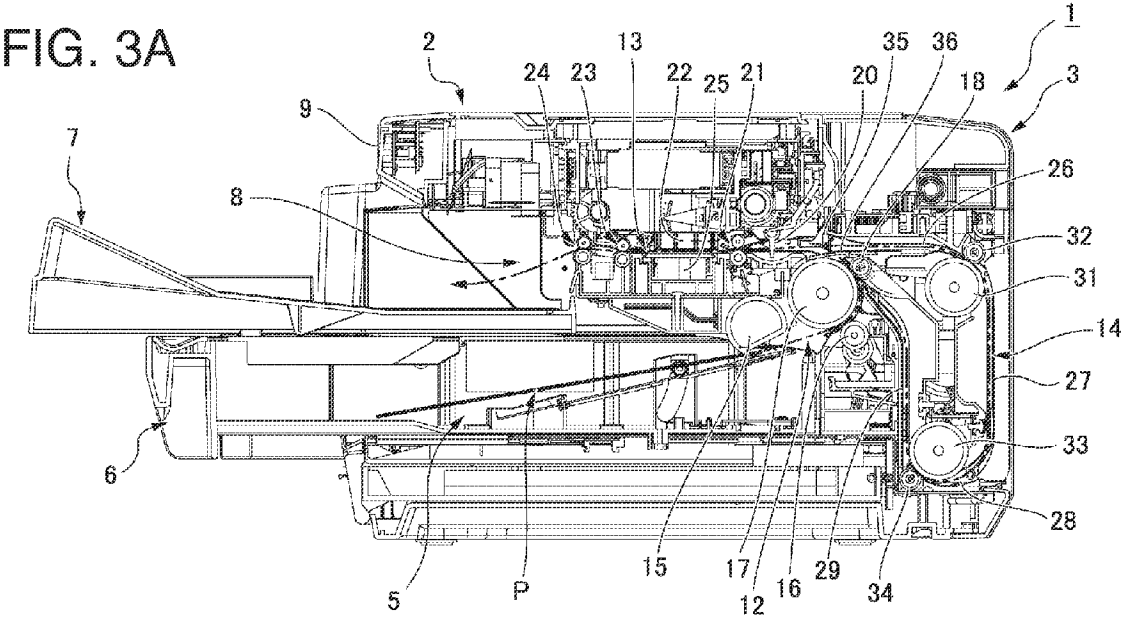
FIG. 3A
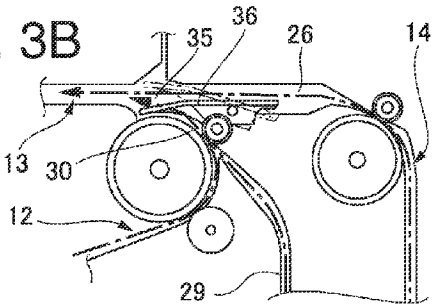
FIG. 3B
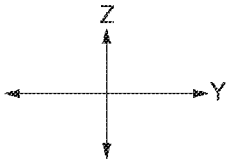

90
100
100a
101
103
104
104a
104b
105
106
107
108
109
110
111
112
114
118a
121
122
123
123a
130
131
132
16
16a
A

MEDIA CONVEYANCE DEVICE AND PRINTER

BACKGROUND

1. Technical Field

The present invention relates to a media conveyance device with a media separation roller that separates multifed sheet media, and to a printer having the media conveyance device.

2. Related Art

Devices having a media separation roller as a media separation mechanism to prevent multifeeding sheet media such as printing paper are known from the literature. The media separation roller is generally called a retard roller, and a mechanism having this roller is called a retard separation mechanism. When recording media are fed to the nipping point between the feed roller and the retard roller in this retard separation mechanism, the medium is advanced by the paper feed roller while a heavy feed load is applied to the media by friction from the retard roller. The retard roller deteriorates over time, including a drop in the media separation force due to wear. As a result, the retard roller is installed in the printer or other apparatus so that the retard roller can be replaced.

JP-A-H06-191670 and JP-A-2012-071918 disclose a sheet feeding device and a recording mechanism that have a replaceable retard roller. The sheet feeding device taught in JP-A-H06-191670 fastens the retard roller installation member to the device with screws, and the retard roller can be replaced by removing the screws. The recording device taught in JP-A-2012-071918 enables sliding the retard roller along the roller axis. To remove the retard roller from the paper path, the retard roller is slid from a fixed operating position to a replacement position.

Examples of apparatuses having a media conveyance device with a retard roller include printers with an automatic two-sided printing capability, scanners and facsimile machines with an automatic two-sided scanning function, and other electronic devices. Devices such as these may also have a reversing conveyance path for reversing the media. For example, after the front (first) side of the paper is printed in a printer with an automatic two-sided printing function, the front and back sides of the recording paper are reversed as the paper travels through a reversing paper path, the back (second) side is then printed.

The reversing paper path may be integrally assembled to the printer frame. A reversing unit having the reversing paper path may also be removably attached to the printer frame. JP-A-2010-280454 and JP-A-2010-274580 disclose an electronic device and a recording device having a removable reversing unit.

The retard roller replacement mechanism taught in JP-A-H06-191670 requires using a tool such as a screwdriver to replace the retard roller. Replacing the retard roller is therefore not simple. The retard roller replacement mechanism taught in JP-A-JP-A-2012-071918 requires sliding the retard roller along the roller shaft in order to replace the retard roller. This requires providing a slide mechanism for sliding the retard roller from the fixed position to the replacement position, and space sufficient to slide the retard roller, inside the paper path. This inhibits reducing the overall size of the apparatus.

The retard roller is also assembled so that it is pushed with a specific amount of pressure to the conveyance roller or the paper feed roller by a spring or other urging member. To replace the retard roller, the retard roller must be separated from the conveyance roller or paper feed roller in resistance to this pressure, and the retard roller removed while this pressure is relieved. Replacing the retard roller is therefore not easy because the retard roller must be removed and installed while pressure is applied.

SUMMARY

A media conveyance device and a printer with a media conveyance device according to the invention enable easily replacing the media separation roller without requiring much space.

A media conveyance device according to one aspect of the invention has a first media conveyance path that conveys a sheet medium; a second media conveyance path that conveys the medium and can change to an open state; a media conveyance roller and a media separation roller disposed in opposition with the first media conveyance path therebetween; and a roller installation unit to which the media separation roller is installed in a state enabling removing and installing the media separation roller from the second media conveyance path side.

The media conveyance device according to the invention enables replacing the media separation roller disposed to the first media conveyance path from the opened second media conveyance path. Compared with a configuration having an opening in the outside case for replacing the media separation roller, a large space can be easily provided in the opened conveyance path, and replacing the media separation roller is simplified. Providing a space such as an opening for replacing the media separation roller in the first media conveyance path is also not necessary. The first media conveyance path to which the media separation roller is disposed can therefore be compactly configured.

When the media conveyance device has a media guide surface defining the second media conveyance path, an opening is formed in the media guide surface, a media conveyance guide that covers the opening can be opened and closed, and the media separation roller can be removably installed through the opening to the roller installation unit.

A media conveyance device according to another aspect of the invention also has a roller holder unit supporting the media separation roller; and the roller holder unit is removably installed in the roller installation unit.

When directly replacing the media separation roller, the surface of the media separation roller can strike the roller installation unit and be damaged. Handling the media separation roller is also not easy when the size of the media separation roller is small. Because the unit to which the media separation roller is assembled is replaced in this aspect of the invention, there is little chance of damaging the media separation roller and replacing the roller is simplified.

Further preferably, the roller holder unit includes the media separation roller, an urging member that applies pressure urging the media separation roller toward the media conveyance roller, and a holder that supports the media separation roller and the urging member; and the roller installation unit includes a holder installation unit that removably supports the holder.

In a media conveyance device according to another aspect of the invention, the roller holder unit can be configured with the holder including a first holder and a second holder; the first holder supporting the media separation roller; the second holder connected to the first holder pivotably on an axis of holder rotation parallel to the axis of rotation of the media separation roller; and the urging member urging the first holder to the second holder in one direction of rotation around the axis of holder rotation. The roller installation unit can be configured with the holder installation unit including a first holder installation unit and a second holder installation unit; the first holder installation unit supporting the first holder rotatably around the axis of holder rotation and removably from a direction intersecting the axis of rotation of the media separation roller (such as perpendicular); and the second holder installation unit removably holding the second holder at a specific position of rotation on the axis of holder rotation.

The first holder supporting the media separation roller is urged by the urging member to pivot on the axis of holder rotation. When the roller holder unit is installed in the unit installation part, the first holder is attached to the unit installation part pivotably on the axis of holder rotation, and is urged in the direction of rotation by the urging force of the urging member. The media separation roller supported by the first holder is therefore held against the media conveyance roller with the specific pressure applied by the urging force.

An urging member for applying pressure pressing the media separation roller to the media conveyance roller is included in the roller holder unit. Installing and removing the media separation roller in resistance to pressure is therefore not necessary. Installing and removing the urging member that applies pressure to the roller is also not necessary when replacing the media separation roller. Installing and removing (replacing) the media separation roller is therefore simple.

Further preferably, the first holder in a media conveyance device according to another aspect of the invention has an engaging part that engages the second holder from the direction of rotation due to the urging force of the urging member.

Before installation to the unit installation part, the roller holder unit is held with the first holder and the second holder engaged by the urging force of the urging member. Handling the roller holder unit is therefore simple because the first and second holders will not rock independently and hit each other. Furthermore, because the first and second holders are rendered in unison, the roller holder unit can be easily positioned in the unit installation part.

In a media conveyance device according to another aspect of the invention, the first holder has a support shaft that defines the axis of holder rotation; the first holder installation unit has a channel that rotatably supports the support shaft, and a channel opening that is formed in the channel and opens in a direction intersecting the axis of rotation of the media separation roller (such as perpendicularly); the shape of the support shaft in a section perpendicular to the axis is a shape of which one side of the perpendicular direction is a wide part and the other side is a narrow part that is narrower than the wide part; and the width of the channel opening is a width that enables the narrow part of the support shaft to pass through and the wide part to not pass through.

The narrow part of the support shaft of the first holder in the roller holder unit can be positioned to the opening in the channel of the first holder installation unit in the unit installation part, and the support shaft can then be inserted to the channel. The first holder of the roller holder unit can therefore be easily attached to the first holder support unit of the unit installation part.

Further preferably, the second holder installation unit has an installation unit-side engaging part; the second holder has a holder-side engaging part that can engage the installation unit-side engaging part from the opposite direction as the direction of rotation around the axis of holder rotation; and the holder-side engaging part is elastically deformable in the direction releasing engagement with the installation unit-side engaging part.

When the support shaft of the first holder is inserted to the channel in the first holder support part, the first and second holders can rotate on the support shaft inserted to the channel (on the axis of holder rotation). The second holder is then rotated until the holder-side engaging part of the second holder passes the installation unit-side engaging part. As a result, the holder-side engaging part of the second holder can be engaged with the installation unit-side engaging part. The roller holder unit can thus be installed to the unit installation part by inserting the support shaft of the first holder to the channel in the first holder installation unit and then rotating the second holder after the support shaft is in the channel. To remove the roller holder unit from the unit installation part, the holder-side engaging part of the second holder is elastically deformed and removed from the installation unit-side engaging part, and the support shaft of the first holder is then removed from the channel.

The roller holder unit can be easily installed and removed from the unit installation part without using a screwdriver or other tools. To install and remove the roller holder unit from the unit installation part, the support shaft of the first holder is moved perpendicularly to the axis of holder rotation, and the second holder is rotated on the axis of holder rotation. Unlike when the media separation roller must be slid along the axis of the media separation roller, a large space for installing and removing the media separation roller is therefore not required in the part of the conveyance path where the media separation roller is located.

In a media conveyance device according to another aspect of the invention, the first holder has a holder-side contact part; and the unit installation part has an installation unit-side contact part that contacts the holder-side contact part of the first holder supported by the first holder installation unit, and can rotate the first holder in the opposite direction as the direction of rotation.

In some instances the media conveyance operation does not convey the media through a path passing the nipping part of the media conveyance roller and the media separation roller. In this event, the media separation roller is preferably removed from the media conveyance roller so that the feed load of the media separation roller does not act on the media conveyance roller. The media separation roller can be easily retraced by disposing a holder-side contact part to the first holder supporting the media separation roller, and retracting the first holder from the media conveyance roller side.

The invention can also be applied to a media conveyance device having a reversing unit with a reversing conveyance path that reverses the front and back sides of the media. The media conveyance device according to this aspect of the invention has a device unit; and a reversing unit attached to the device unit removably or pivotably on a predetermined opening and closing axis. The device unit includes a unit-side conveyance path that conveys the medium, a media storage unit that stores the media in a stack, and a media supply path that supplies the media from the media storage unit to the unit-side conveyance path. The reversing unit includes a reversing conveyance path that reverses the front and back of media conveyed from the unit-side conveyance path and returns the media to the unit-side conveyance path. The media supply path is the first media conveyance path; and part of the reversing conveyance path is the second media conveyance path.

Another aspect of the invention is a printer having the media conveyance device of the invention; and a print unit that prints on the media conveyed through the unit-side conveyance path of the media conveyance device.

Other objects and attainments together with a fuller understanding of the invention will become apparent and appreciated by referring to the following description and claims taken in conjunction with the accompanying drawings.

BRIEF DESCRIPTION OF THE DRAWINGS

FIGS. 3A and 3B are a vertical section view and a partial section view respectively of the printer shown in FIG. 1.

DESCRIPTION OF EMBODIMENTS

A preferred embodiment of the present invention is described below with reference to the accompanying figures. The following embodiment describes the invention applied to a printer having a reversing unit enabling two-sided (duplex) printing. The invention can obviously also be applied to devices other than printers, including scanners and facsimile machines having a reversing unit. The invention can also be applied to media conveyance devices that supply media to devices such as printers and scanners.

General Configuration of a Printer

Figure 1:
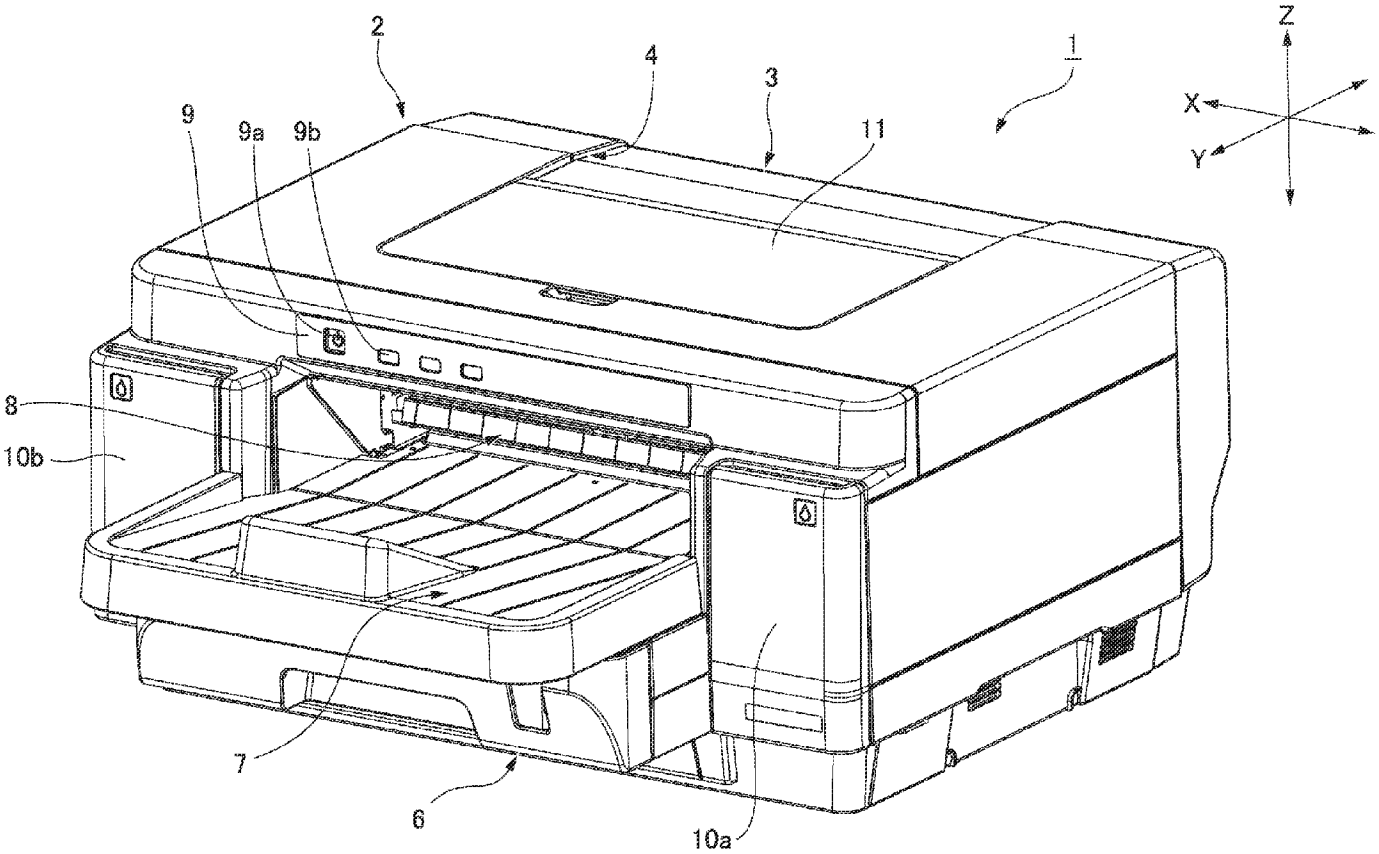
FIG. 1 is an oblique front view of a printer according to the invention.
Figure 2:
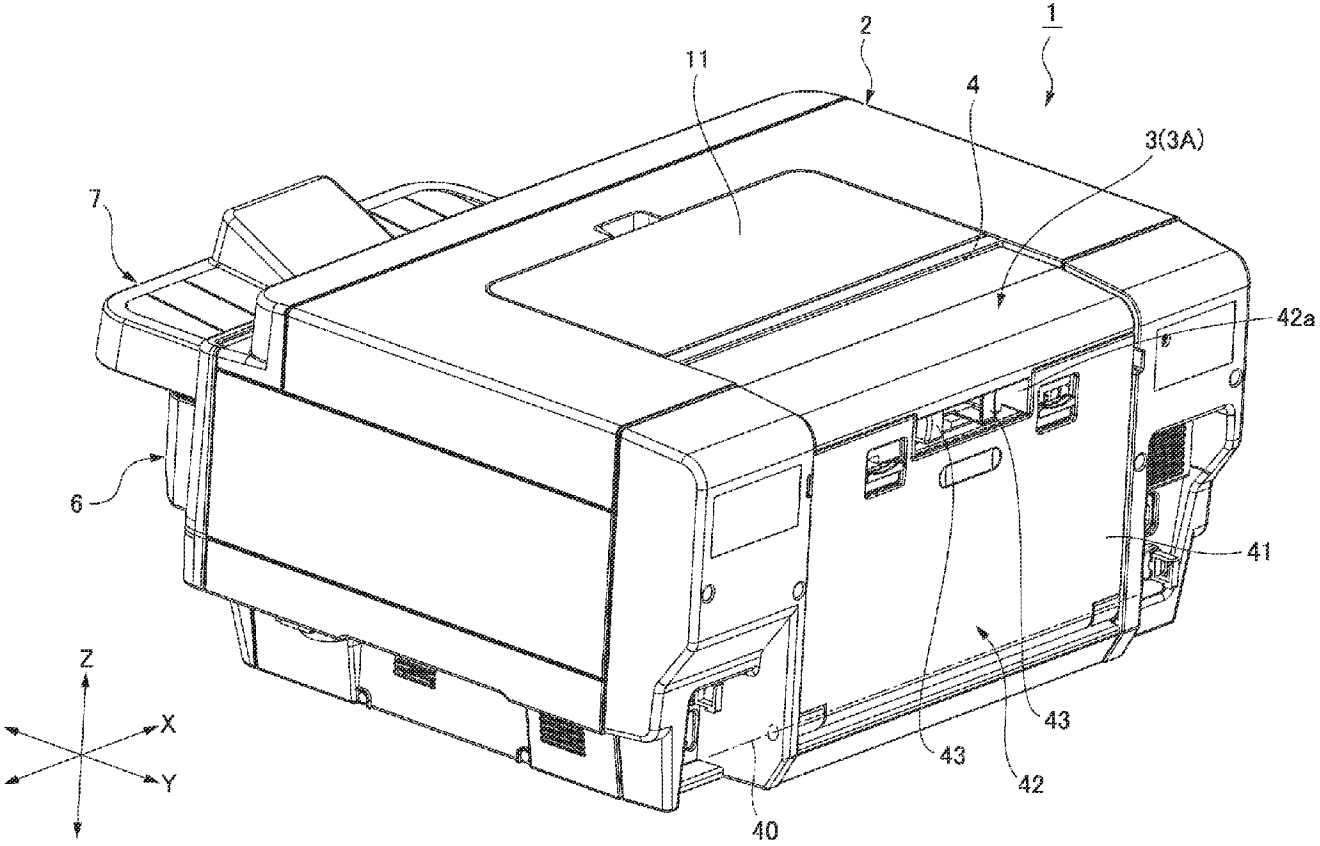
FIG. 2 is an oblique rear view of a printer according to the invention.

FIG. 1 is an external oblique view from the front of an inkjet printer ("printer" below) according to this embodiment of the invention, and FIG. 2 is an external oblique view of the printer from the back. FIG. 3 (*a*) is a vertical section view and FIG. 3 (*b*) is a partial section view of the internal configuration of the printer.

The general configuration of the printer 1 is described referring primarily to FIG. 1 and FIG. 2. The printer 1 has a printer cabinet 2 and a reversing unit 3. The printer cabinet 2 has a basically rectangular box-like shape that is long on the transverse axis X widthwise to the printer, and has a recess 4 in the middle of the back where the reversing unit 3 is installed. The reversing unit 3 is a unit for reversing the front and back sides of the printing paper ("paper" below), which is a form of sheet media, and then returning the reversed paper to the printer cabinet 2. The reversing unit 3 is a reversing unit that can open and close as further described below, and can pivot on the bottom part on the vertical axis Z of the printer to open to the back of the printer on the longitudinal axis Y.

A paper cassette loading unit 5 is disposed to the front of the printer cabinet 2. The paper cassette loading unit 5 opens to the front on the longitudinal axis Y at a position toward the bottom on the vertical axis Z in the front of the printer cabinet 2. A paper cassette 6 can be loaded from the front into the paper cassette loading unit 5. A paper discharge tray 7 is attached at the top of the paper cassette loading unit 5. The paper discharge tray 7 extends substantially horizontally to the front. A rectangular paper exit 8 extending toward the back of the printer is formed at the top of the paper discharge tray 7.

An operating panel 9 is at the front of the printer above the paper exit 8. The operating panel 9 includes a power switch 9*a* and a plurality of state indicators 9*b*. Rectangular access doors 10*a*, 10*b* are attached to the front of the printer on opposite sides of the paper discharge tray 7 and paper exit 8. When the access doors 10*a*, 10*b* are open, the ink cartridge loading unit (not shown in the figure) opens and the ink cartridges (not shown in the figure) can be replaced.

The top of the printer is flat, and has an access cover 11 attached in the middle for maintenance.

Internal Configuration of the Printer

The internal configuration of the printer 1, and particularly the paper conveyance path, is described next with reference to FIG. 3. A paper supply path 12, main conveyance path 13, and reversing conveyance path 14 are formed inside the printer 1. The paper supply path 12 and main conveyance path 13 are formed inside the printer cabinet 2, and the reversing conveyance path 14 is formed inside the reversing unit 3.

The paper supply path 12 is a conveyance path that conveys paper P of a specific size stored in a stack in the paper cassette 6 to the main conveyance path 13. The paper supply path 12 extends diagonally up from the back end of the paper cassette loading unit 5 on the longitudinal axis Y, curves toward the front, and connects to the main conveyance path 13. Paper P stored in the paper cassette 6 is fed by a paper feed roller 15 to the paper supply path 12. The supplied paper is fed one sheet at a time through the nipping part of a conveyance roller 17 and a retard roller 16, which is a media separation roller. The paper supply path 12 is a first media conveyance path where the conveyance roller 17 and retard roller 16 are disposed with the paper supply path 12 therebetween. The paper P conveyed through the nipping part of the retard roller 16 and conveyance roller 17 is conveyed through the nipping part of the conveyance roller 17 and a follower roller 18 to the main conveyance path 13.

The main conveyance path 13 is the conveyance path extending substantially horizontally along the longitudinal axis Y to the paper exit 8. Disposed along the main conveyance path 13 from the upstream side in the paper conveyance direction are a paper detection lever 20, a paper feed roller pair 21, a printhead 22, a first discharge roller pair 23, and a second discharge roller pair 24. The printhead 22 is an inkjet head, and a platen 25 is disposed opposite the nozzle face with a specific gap therebetween.

Paper fed from the paper supply path 12 to the main conveyance path 13 is conveyed by the conveyance roller 17 to the paper feed roller pair 21 while pushing up on the paper detection lever 20. The paper fed into the paper feed roller pair 21 is conveyed past the printing position of the printhead 22 by the paper feed roller pair 21 toward the first discharge roller pair 23. The paper fed to the first discharge roller pair 23 passes the first discharge roller pair 23 and second discharge roller pair 24, and is discharged from the paper exit 8 onto the paper discharge tray 7.

The reversing conveyance path 14 formed inside the reversing unit 3 is located below the main conveyance path 13 on the vertical axis Z, and is a conveyance path that generally forms a loop. The reversing conveyance path 14 includes an upstream path 26 that connects to the upstream end of the main conveyance path 13 and extends substantially horizontally to the back on the longitudinal axis Y, a descending path 27 that curves and extends down in a straight line on the vertical axis Z from the upstream path 26, a bottom path 28 that connects to the descending path 27 and curves to the front on the longitudinal axis Y, and an ascending path 29 that curves and extends upward from the bottom path 28.

The top part of the ascending path 29 curves at an angle to the printer front, and merges with the paper supply path 12 in the middle. More specifically, ascending path 29 and the downstream part of the paper supply path 12 form a common path 30. This common path 30 is a curved path extending along the outside of the conveyance roller 17.

A first conveyance roller 31 and a follower roller 32 are disposed between the upstream path 26 and the descending path 27, and a second conveyance roller 33 and a follower roller 34 are disposed between the bottom path 28 and the ascending path 29. Paper conveyed from the main conveyance path 13 to the reversing conveyance path 14 is nipped by the first conveyance roller 31 and follower roller 32, then conveyed by the first conveyance roller 31 to the nipping part of the second conveyance roller 33 and follower roller 34, and then conveyed by the second conveyance roller 33 to the nipping part of the conveyance roller 17 and follower roller 18. The paper is then fed by the conveyance roller 17 to the main conveyance path 13 again.

By passing through the loop of this reversing conveyance path 14, the paper is reversed front and back and returned to the main conveyance path 13. Printing on both sides of the paper is therefore enabled by conveying the paper through the reversing conveyance path 14.

A path-changing flapper 36 is disposed at the junction 35 of the upstream end of the main conveyance path 13, the upstream end of the reversing conveyance path 14, and the downstream end of the common path 30. The path-changing flapper 36 can pivot up and down on the vertical axis Z at the back end of the flapper 36 on the longitudinal axis Y. The path-changing flapper 36 is normally held by its own weight in a first position with the main part of the flat at the front on the longitudinal axis Y resting on the outside of the conveyance roller 17.

Paper reversed from the main conveyance path 13 side in this position is guided by the path-changing flapper 36 to the reversing conveyance path 14 side. The paper then passes through the reversing conveyance path 14 and returns to the junction 35. The path-changing flapper 36 is pushed up by the paper returned to the junction 35, and can move from the first position to a second position. When the path-changing flapper 36 is pushed up to the second position, the common path 30 at the downstream end of the reversing conveyance path 14 communicates with the main conveyance path 13. The paper is therefore conveyed to the main conveyance path 13 while pushing the path-changing flapper 36 up. After the paper has past, the path-changing flapper 36 returns by its own weight to the first position.

The path-changing flapper 36 is also pushed up by the paper fed from the paper supply path 12 to the main conveyance path 13 when paper is supplied from the paper cassette 6. After the paper passes, the path-changing flapper 36 returns of its own weight to the first position. Paper reversed from the main conveyance path 13 will therefore not go through the common path 30 into the reversing conveyance path 14 or the paper supply path 12. The paper path can also be changed by a simple configuration without using a separate drive power source or urging member.

Openable Reversing Unit

Figure 4:
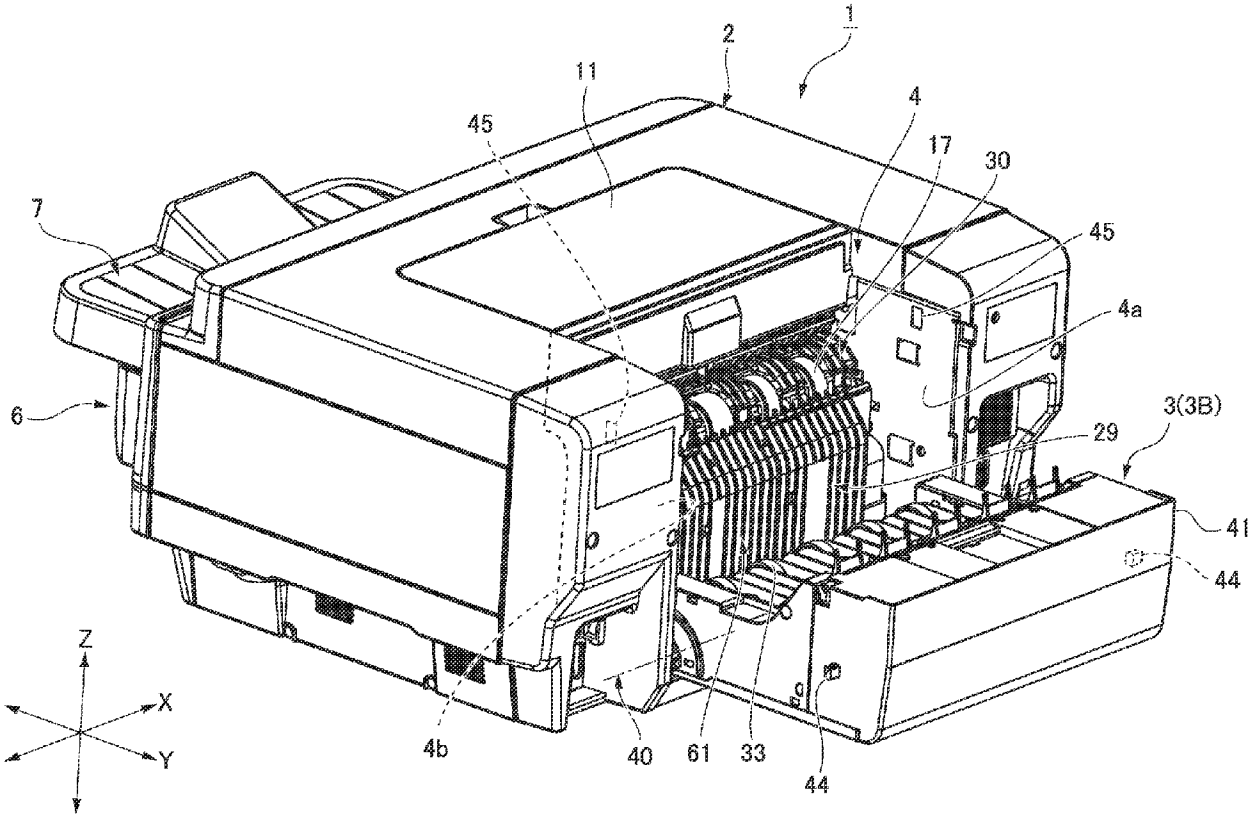
FIG. 4 is an oblique rear view of the printer in FIG. 1 with the reversing unit open.

FIG. 4 is an external oblique view from the back of the printer 1 when the reversing unit 3 is open.

As will be understood from FIG. 2 and FIG. 4, the reversing unit 3 can open and close pivoting on a pivot axis 40 located at the bottom on the vertical axis Z of the printer. When in the closed position 3A shown in FIG. 2, the reversing unit 3 is standing upright on the vertical axis Z, and the back cover 42 of the reversing unit case 41 is positioned substantially flush with the back left and right sides of the printer cabinet 2. In the open position 3B shown in FIG. 4, the reversing unit 3 is dropped to the back on the longitudinal axis Y to a substantially level position. In the open position 3B, the ascending path 29 on the downstream side of the reversing conveyance path 14, and the common path 30, are open as will be understood from FIG. 4. Paper jams and other problems occurring on these conveyance paths can be easily handled by opening the reversing unit 3. The common path 30 and the ascending path 29 portion of the reversing conveyance path 14 are an openable second media conveyance path.

As shown in FIG. 2, the reversing unit 3 has an opening 42*a* in the middle at the top of the back cover 42 on the vertical axis Z. A pair of lever operators 43 are exposed through this opening 42*a*. When the pair of lever operators 43 is operated so that they close together, left and right lock pins 44 (FIG. 4) protruding to the side from the left and right sides of the reversing unit 3 disengage matching catches 45 (FIG. 4) formed in the left and right sides 4*a*, 4*b* of the recess 4 in the printer cabinet 2. The reversing unit 3 is thus unlocked and can be opened.

Opening for Replacing the Retard Roller

Figure 5:
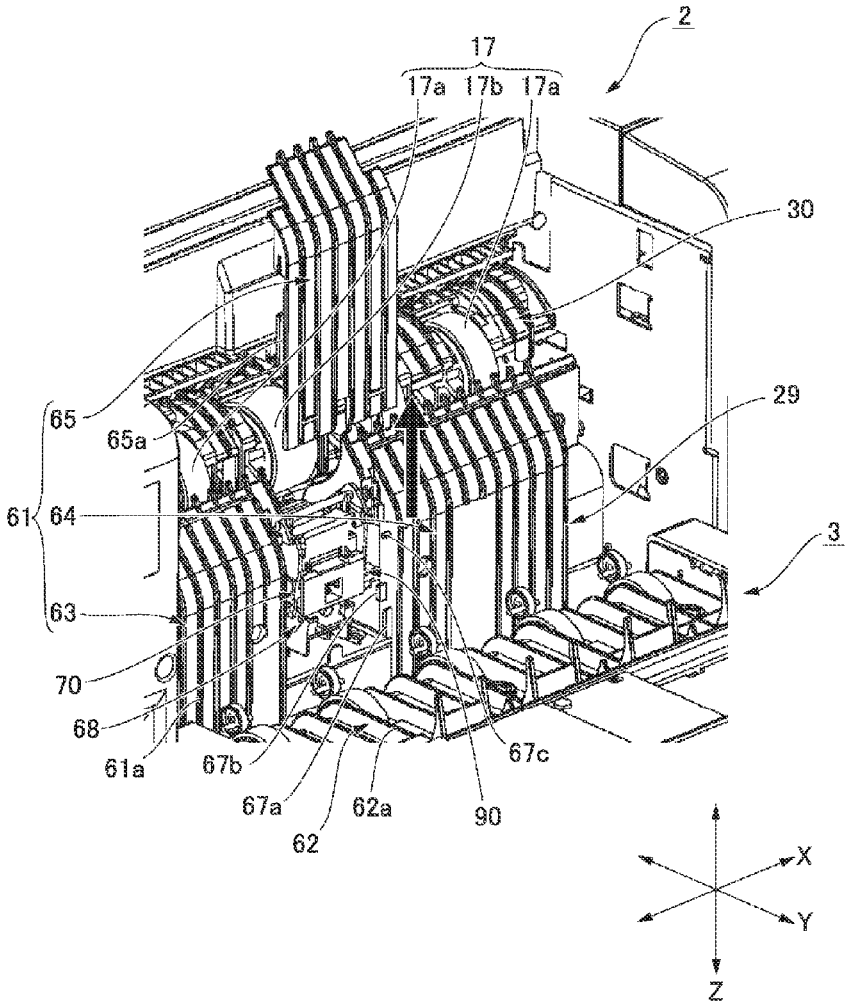
FIG. 5 shows the opening for replacing the retard roller.

FIG. 5 describes an opening for replacing the retard roller 16. As shown in FIG. 5, the ascending path 29, which is part of the reversing conveyance path 14, and the common path 30 open when the reversing unit 3 is opened. Part of the outside surface of the conveyance roller 17, which constitutes the conveyance path surface on the printer cabinet 2 side of the common path 30, is also exposed.

The ascending path 29 is formed between a conveyance guide panel 61 disposed on the printer cabinet 2 side, and a conveyance guide panel 62 disposed on the reversing unit 3 side. Plural ribs 61*a*, 62*a* are formed extending parallel to the media conveyance direction on the surface of the conveyance guide panels 61, 62. The conveyance guide surface on the printer side and the conveyance guide surface on the reversing unit side of the ascending path 29 are determined by the exposed outside surfaces of the ribs 61*a*, 62*a*.

The conveyance guide panel 61 on the printer cabinet 2 side includes conveyance guide panels 63, 64 on opposite sides of the transverse axis X, and a conveyance guide panel 65 located therebetween. The conveyance guide panel 65 is positioned in the middle on the transverse axis X between the side conveyance guide panels 63, 64 and can be removed from the top on the vertical axis Z as shown in FIG. 5. In this example, a slide rail 65*a* is formed on both sides of the conveyance guide panel 65, and plural guide tabs 67*a*, 67*b*, 67*c* that guide the slide rail 65*a* are formed on the inside faces of the conveyance guide panels 63, 64.

Sliding the conveyance guide panel 65 up as indicated by the arrow in the figure and removing both conveyance guide panels 63, 64 opens the retard roller replacement opening 68 formed between the conveyance guide panels 63, 64. The retard roller installation unit 70 that is installed in the printer cabinet 2 is accessible from the retard roller replacement opening 68. A roller holder unit 90 that holds the retard roller 16 (FIG. 3) is removably installed to the retard roller installation unit 70. The roller holder unit 90 is installed in the retard roller installation unit 70 so that the roller holder unit 90 can be removed through the retard roller replacement opening 68 from the open reversing conveyance path 14 (ascending path 29) side. Because the retard roller 16 is installed as a unit in the retard roller installation unit 70 in this embodiment, the retard roller installation unit 70 is also referred to as a unit installation part 70 below. The roller holder unit 90 is also referred to as simply unit 90.

Figure 6A:
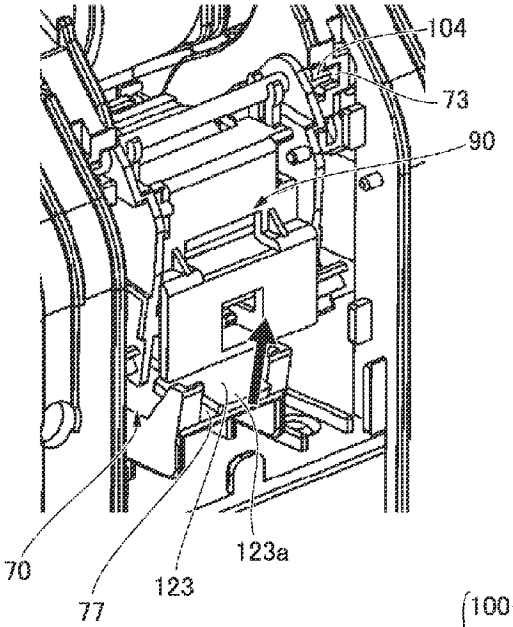
FIGS. 6A and 6B show the roller installation unit where the retard roller is installed.
Figure 6B:
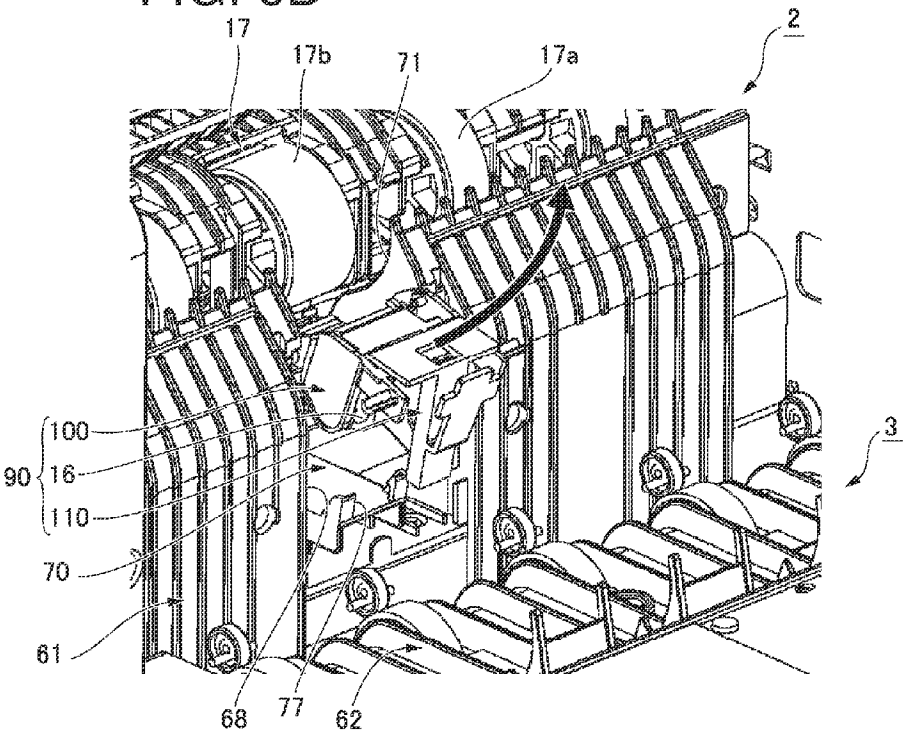

FIG. 6A and FIG. 6B describe removing the roller holder unit 90 from the retard roller installation unit 70. The operation of removing the unit 90 from the unit installation part 70 is described below with reference to FIG. 4, FIG. 5, and FIG. 6A and FIG. 6B before describing the specific configuration of the unit installation part 70 and unit 90.

To remove the unit 90 from the unit installation part 70, the user first opens the reversing unit 3 as shown in FIG. 4. Next, the conveyance guide panel 65 is pulled up as indicated by the arrow in FIG. 5, and removed from the printer cabinet 2. Next, as indicated by the arrow in FIG. 6A, the engaging plate 123 (holder-side engaging part) of the unit 90 is elastically deformed as indicated by the arrow in FIG. 6A, and the engaging plate 123 is raised and removed from the engaging channel 77 (installation unit-side engaging part) of the unit installation part 70. When the engaging plate 123 is lifted up and removed from the engaging channel 77, the unit 90 can rotate upward as indicated in FIG. 6B pivoting on pivot pins 104 formed on opposite sides at the top. When the roller holder unit 90 rotates up a specific distance, the pivot pins 104 can be pulled out to the back from channels 73 on the unit installation part 70 side. When the pivot pins 104 of the roller holder unit 90 are removed from the channels 73 in the retard roller installation unit 70, the unit 90 can be completely removed from the retard roller installation unit 70 and removed from the printer cabinet 2 through the retard roller replacement opening 68.

Roller Holder Unit and Retard Roller Installation Unit

Figure 7:
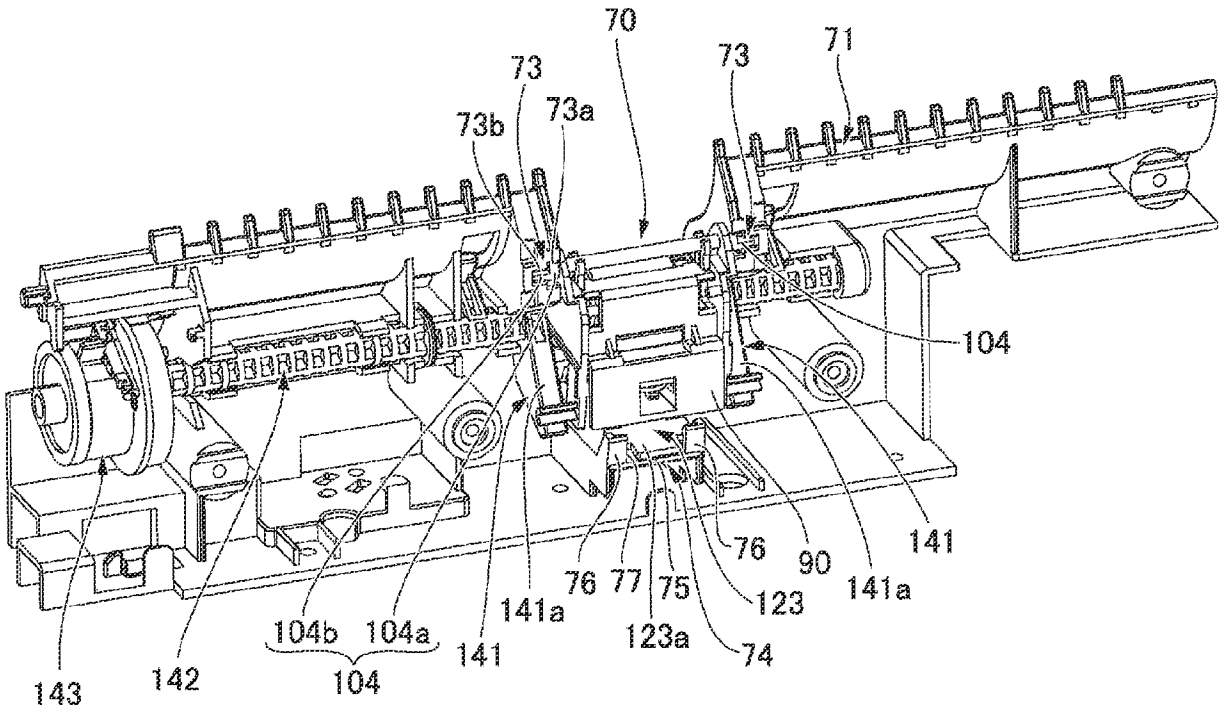
FIG. 7 shows the roller installation unit with the retard roller installed.
Figures 8A, 8B, 8C, 8D:
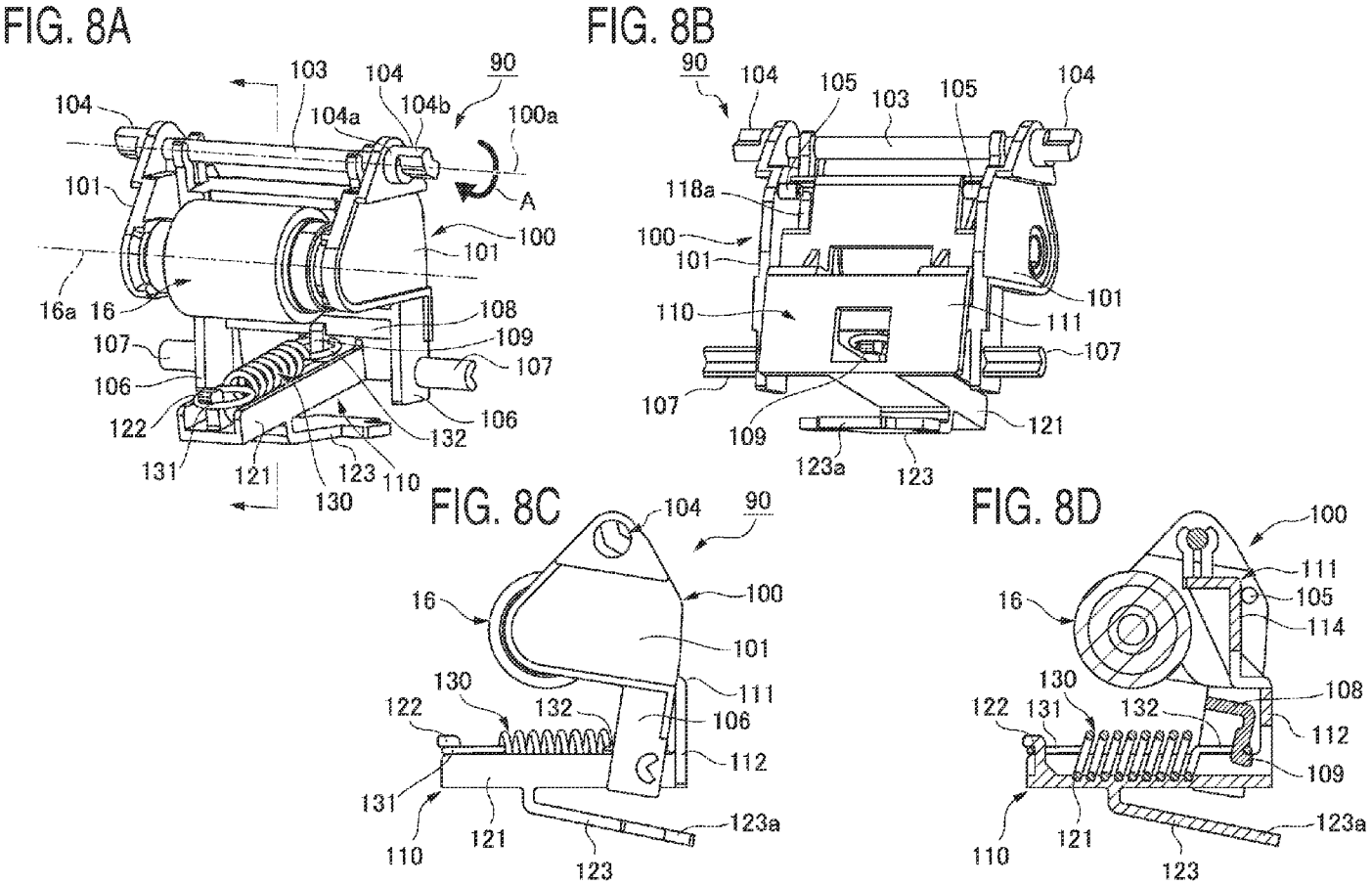
FIGS. 8A, 8B, 8C and 8D show a roller holder unit.
Figure 9B:
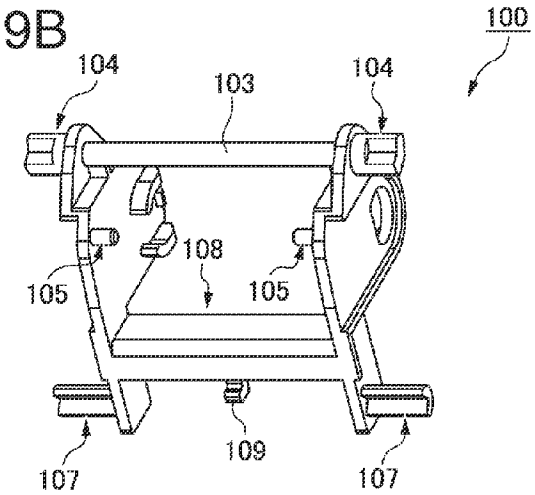
FIGS. 9A, 9B and 9C show a first holder.
Figure 9A:
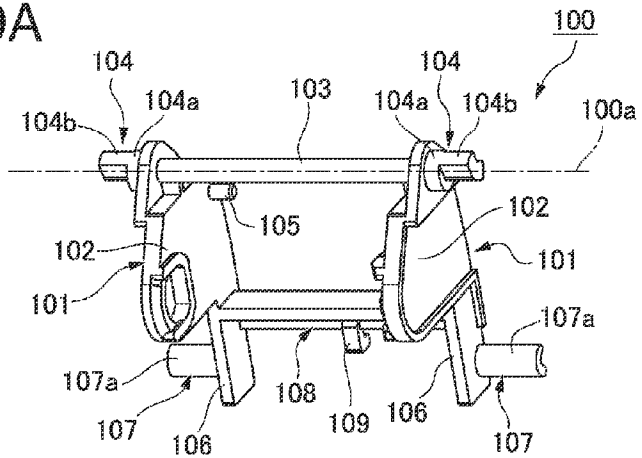
Figure 9C:
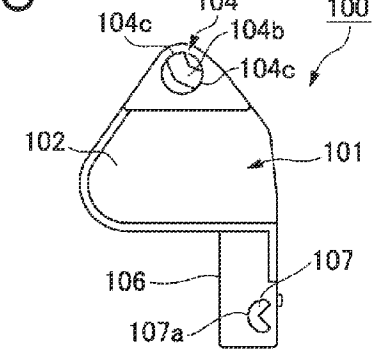
Figure 10B:
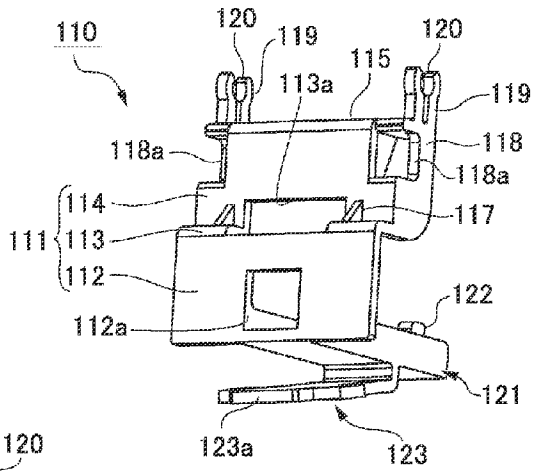
FIGS. 10A, 10B and 10C a second holder.
Figure 10A:
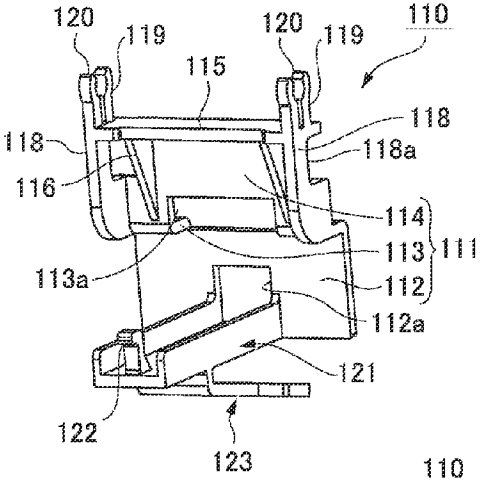
Figure 10C:
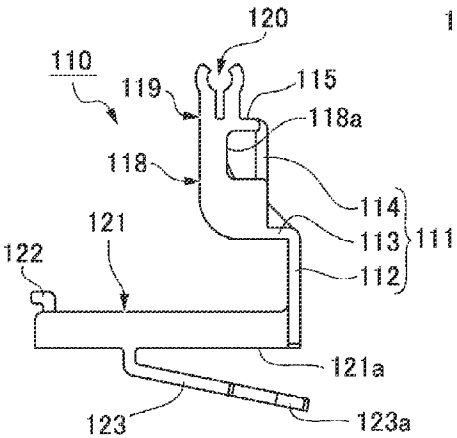

The roller holder unit 90 and retard roller installation unit 70 are further described below with reference to FIG. 7, FIG. 8, FIG. 9, and FIG. 10. FIG. 7 shows the retard roller installation unit 70 to which the roller holder unit 90 is installed on the printer cabinet 2 side. FIG. 8A to FIG. 8D are, respectively, a front oblique view, rear oblique view, side view, and section view of the roller holder unit 90. FIG. 9A to FIG. 9C are, respectively, a front oblique view, rear oblique view, and side view of a first holder, which is a part of the roller holder unit 90. FIG. 10A to FIG. 10C are, respectively, a front oblique view, rear oblique view, and side view of a second holder that is also part of the roller holder unit 90.

The longitudinal axis, transverse axis, and vertical axis of the roller holder unit 90 when installed in the printer cabinet 2 are the same as the longitudinal axis Y, transverse axis X, and vertical axis Z of the printer. The unit 90 in this example is symmetrically shaped left and right on the transverse axis, and made from parts that are symmetrical left and right. Left and right parts are therefore identified by the same reference numerals.

The general configuration of the roller holder unit 90 is described below with reference to FIG. 8. The roller holder unit 90 includes the retard roller 16, a first holder 100, a second holder 110, and a tension spring 130. The first holder 100 supports the retard roller 16. The first holder 100 is connected to the second holder 110 and can rotate on an axis of holder rotation 100*a* that is parallel to the axis of rotation 16*a* of the retard roller 16. The tension spring 130 spans between the first holder 100 and the second holder 110. The first holder 100 is urged to pivot relative to the second holder 110 in a first direction of rotation A, which is clockwise in the figure, on the axis of holder rotation 100*a*. An engaging pin 105 is disposed on each side of the first holder 100. The engaging pins 105 are engaged with the engaging surfaces 118*a* on each side of the second holder 110 from the first direction of rotation A by the tension of the tension spring 130.

The configuration of the first holder 100 is described next with reference to FIG. 8 and FIG. 9. The first holder 100 has end plates 101 extending parallel to the longitudinal axis of the holder with a specific gap therebetween. Each end plate 101 has a header 102 with a basically triangular contour that increases in width from the top to the bottom on the vertical axis. A through-shaft 103 extends on the transverse axis perpendicularly to the header 102 between the top corners of the headers 102. The pivot pins 104 protrude to the outside from the outside surfaces of the end plates 101 coaxially to the through-shaft 103. The part of the pivot pin 104 connected to the end plate 101 is a round shaft portion 104*a*, and the distal end of the round shaft portion 104*a* is a flat 104*b* that is flat and bends to one side when seen in section. More specifically, the shape of the flat 104*b* when seen in section perpendicularly to the axis of the pivot pin 104 is wide on one side and narrow on the other side in the direction perpendicular to the axis. The sides of the flat 104*b* are curved surfaces with the same outside diameter as the round shaft portion 104*a*.

The retard roller 16 (see FIG. 8) is disposed on the transverse axis perpendicularly to and between the corners of the headers 102 protruding at the front of the end plates 101. An engaging pin 105 is formed parallel to the axis of holder rotation 100*a* at a position at the back of the header 102 of the end plate 101.

A rectangular leg 106 extends down from the back bottom part of the header 102 of the end plate 101. A holder-side contact pin 107 is formed extending parallel to the axis of holder rotation 100*a* on the outside surface of the leg 106. The front outside surface of the holder-side contact pin 107 is a curved contact surface 107*a*. The tops of the legs 106 of the left and right end plates 101 are connected by a connection plate 108 extending perpendicularly to the endplates 101. A rear spring catch 109 is formed extending down from the middle of the width of the connection plate 108. The back end 132 on the longitudinal axis of the tension spring 130 is mounted from the back on the rear spring catch 109.

The configuration of the second holder 110 is described next with reference to FIG. 8 and FIG. 10. The second holder 110 is a holder of a width enabling it to be placed between the left and right end plates 101 of the first holder 100. The second holder 110 has a back panel 111 that curves in the middle on the vertical axis. The access cover 11 has a rectangular bottom back portion 112, a horizontal portion 113 that bends perpendicularly to the front from the top end of the bottom back portion 112, and a top back portion 114 that bends perpendicularly up from the front edge of the horizontal portion 113. A top ceiling member 115 bends perpendicularly to the front from the top edge of the top back portion 114. A rectangular opening 112*a* is formed in the middle of the width of the bottom back portion 112. A rectangular opening 113*a* is also formed in the middle of the width from the horizontal portion 113 to the bottom of the top back portion 114. The top back portion 114 is wider at the top than the bottom. A triangular reinforcing rib 116 is formed on the front of the back panel 111 extending vertically between the top ceiling member 115 and the top back portion 114. Another triangular reinforcing rib 117 is formed on the back of the back panel 111 extending vertically between the horizontal portion 113 and the top back portion 114.

An end panel 118 is formed on each side of the width of the back panel 111. The end panels 118 are formed to connect the bottom part of the top back portion 114 to the corresponding ends of the top ceiling member 115. A shaft connector 119 formed to each end panel 118 projects up from the top ceiling member 115. Each shaft connector 119 forks to the front and back, and has a round channel 120 that is open to the top formed at the top end. The through-shaft 103 of the first holder 100 is rotatably inserted from above into the channels 120. The through-shaft 103 inserted to the channels 120 is held in the channel 120 by the elastic restoring force of the shaft connector 119. As a result, the first holder 100 and second holder 110 are held together and can pivot relative to each other on the axis of holder rotation 100*a*.

The engaging surfaces 118*a* are formed to the part of the end panels 118 corresponding to the narrow top part of the top back portion 114. The engaging surfaces 118*a* are end surfaces that face the back, and can be engaged by the matching engaging pin 105 of the first holder 100 from the back.

A spring mount 121 extending straight to the front is formed to the front of the bottom back portion 112 of the back panel 111. The spring mount 121 is a rectangular channel that is open at the top. A front spring catch 122 is formed protruding up at the front end of the spring mount 121. The opening 112*a* in the bottom back portion 112 is positioned at the back end of the spring mount 121. As will be understood from FIG. 8, the tension spring 130 is mounted in the spring mount 121, and the front end 131 of the tension spring 130 is held by the front spring catch 122 from the front.

The engaging plate 123 is formed extending at a downward angle to the back at a position near the longitudinal center of the bottom 121*a* of the spring mount 121. The distal end of the engaging plate 123 is notched on both sides, forming a narrow engaging part 123*a*. The engaging plate 123 can elastically deform in the direction approaching the bottom 121*a* of the spring mount 121.

Assembling the first holder 100, second holder 110, and tension spring 130 is described next with reference to FIG. 8. The second holder 110 is first inserted between the end plates 101 of the first holder 100 from the back of the first holder 100. The through-shaft 103 of the first holder 100 is pressed from above into the channel 120 of the second holder 110, and the first and second holders 100, 110 are thereby connected pivotably relative to each other around the axis of holder rotation 100*a*. The engaging pins 105 of the first holder 100 are positioned behind the engaging surfaces 118*a* of the second holder 110. The rear spring catch 109 formed to the connection plate 108 of the first holder 100 is positioned near the back end of the spring mount 121 of the second holder 110.

The front end 131 of the tension spring 130 is mounted on the front spring catch 122 of the second holder 110, and the back end 132 is mounted on the rear spring catch 109 of the first holder 100. The tension spring 130 is held in a specifically tensioned state by the front and back spring catches 122, 109. The first holder 100 is urged to pivot on the axis of holder rotation 100*a* to the second holder 110 in the first direction of rotation A by the spring tension of the tension spring 130. In other words, the second holder 110 is pressed to the first holder 100 from the front. As a result, the engaging pins 105 of the first holder 100 contact and engage the engaging surfaces 118*a* of the second holder 110 from the back. The first holder 100 and second holder 110 are thus assembled together with no play therebetween in the roller holder unit 90.

The configuration of the retard roller installation unit 70 disposed on the printer cabinet 2 side is described next with reference to FIG. 5 to FIG. 8. As will be understood from FIG. 5 and FIG. 6, the unit installation part 70 is disposed between the conveyance guide 71 on the printer cabinet 2 side opposite the conveyance roller 17, and the conveyance guide panel 61 on the reversing unit 3 side. Conveyance guide 71 defines one paper conveyance surface of the paper supply path 12, and conveyance guide panel 61 defines one paper conveyance surface of the ascending path 29 part of the reversing conveyance path 14. A wide roller 17*b* that is wider than the rollers 17*a* on either side is disposed to the middle of the conveyance roller 17 in the transverse direction. An opening is formed in the part of the conveyance guide 71 opposite the wide roller 17*b*. When the unit 90 is installed in the unit installation part 70 through the opening 68 formed in the conveyance guide panel 61 positioned on the back side of the conveyance guide 71, the retard roller 16 is opposite the wide roller 17*b* part of the conveyance roller 17.

As will be understood from FIG. 7, channel 73 is formed as a first holder installation unit in the top on both sides of the width of the unit installation part 70. The channels 73 pivotably and removably support the pivot pins 104 of the first holder 100 of the unit 90. The channels 73 are formed on both sides of the opening 68, and are open to the back of the printer. The inside diameter of the channels 73 is sized to support the pivot pins 104 rotatably. The opening to the channels 73 facing the back of the printer includes a wide shaft opening 73*a* to which the round shaft portion 104*a* of the pivot pins 104 can be inserted, and a narrow shaft opening 73*b* to which the narrow part of the flat 104*b* of the pivot pins 104 can be inserted. As will be understood from FIG. 8A, the flats 104*b* of the pivot pins 104 are shaped to rise at an angle to the front when seen in section view perpendicularly to the axis of the pivot pin 104. Therefore, as shown in FIG. 6B, if the roller holder unit 90 is tilted so that the flats 104*b* of the pivot pins 104 are substantially horizontal, the pivot pins 104 can be inserted to the channels 73. If the unit 90 is then rotated around the pivot pins 104 as shown in FIG. 6A to the vertical position after inserting the pivot pins 104 to the channels 73, the pivot pins 104 are prevented from exiting the channels 73.

A second holder engaging part 74 is disposed as a second holder installation unit to the bottom of the unit installation part 70. The second holder engaging part 74 has a rectangular engaging channel 77 formed by a bottom plate 75 and a pair of end panels 76. The bottom plate 75 is a flat panel extending in the longitudinal axis of the printer, and the end panels 76 extend vertically upward from both back end sides of the bottom plate 75. The engaging channel 77 is open along the longitudinal axis of the printer, and the width of this opening is narrower than the engaging plate 123 of the second holder 110 and wider than the engaging part 123*a* formed at the distal end of the engaging plate 123.

The vertical distance from the channels 73 in the unit installation part 70 to the top edge of the engaging channel 77 (the top edge of the end panels 76) is shorter than the vertical distance from the channel 120 in the second holder 110 to the engaging part 123*a*. When the pivot pins 104 of the unit 90 are inserted to the channels 73 of the retard roller installation unit 70, and the unit 90 is rotated on the pivot pins 104 toward the front of the printer, the engaging plate 123 of the unit 90 contacts the end panels 76 of the unit installation part 70. Because the engaging plate 123 can deform elastically, the unit 90 can be pivoted to the vertical installation position to the unit installation part 70 as shown in FIG. 7 by elastically deforming the engaging plate 123 upward. When the engaging plate 123 returns elastically to the original position, the engaging part 123*a* on the distal end thereof can engage the engaging channel 77 from the front.

The retard roller 16 of the installed unit 90 is pressed by the spring force of the tension spring 130 to the wide roller 17*b* of the conveyance roller 17. More specifically, because the tension of the tension spring 130 is applied between the first and second holders 100, 110, the first holder 100 is urged toward the front of the printer. The retard roller 16 of the unit 90 installed in the unit installation part 70 is held in a position pressed to the wide roller 17*b* of the conveyance roller 17 by the urging force of the tension spring 130. As a result, the engaging plate 123 of the second holder 110 receiving the spring force is engaged from the front by the engaging channel 77, and is held stationary in the unit installation part 70. The first holder 100 supporting the retard roller 16 can pivot relative to the unit installation part 70 around the axis of holder rotation 100*a* in resistance to the spring force.

The printer 1 according to this embodiment of the invention also has a retraction mechanism 140 for separating the retard roller 16 from the conveyance roller 17. As shown in FIG. 7, the retraction mechanism 140 has a pivot arm 141 on each side of the unit installation part 70, a pivot shaft 142 to which the pivot arms 141 are attached, and a drive mechanism 143 that causes the pivot shaft 142 to turn. The pivot arm 141 has contact surfaces 141*a* facing the back of the printer. The first holder 100 of the unit 90 has a contact pin 107 on both sides. When the unit 90 is installed to the unit installation part 70, the contact pins 107 of the first holder 100 oppose the contact surfaces 141*a* from the back.

When the retraction mechanism 140 is driven and the pivot arms 141 rotate to the back, the contact surfaces 141*a* contact the contact surfaces 107*a* of the contact pins 107 of the first holder 100. As the pivot arms 141 continue turning, the first holder 100 is rotated to the back on the axis of holder rotation 100*a* in resistance to the urging force of the tension spring 130. As a result, the retard roller 16 supported by the first holder 100 moves to the back away from the conveyance roller 17. The retard roller 16 is thus retracted so that the retarding load of the retard roller 16 does not act on the conveyance roller 17 when the paper P is conveyed through the reversing conveyance path 14 and returned to the main conveyance path 13, for example.

As described above, the printer 1 according to the invention has an opening 68 for replacing a retard roller disposed to a reversing conveyance path 14 that opens when the reversing unit 3 is opened. This opening 68 is covered by a conveyance guide panel 65 that defines a conveyance guide surface. To replace the retard roller 16, the reversing unit 3 is opened, the conveyance guide panel 65 removed, and the opening 68 opened. The unit 90 installed in the unit installation part 70 is thus exposed (see FIG. 5).

When the engaging part 123*a* of the unit 90 is elastically deformed upward, the engaging part 123*a* separates from the engaging channel of the unit installation part 70. By holding the engaging part 123*a* and rotating the unit 90 up, the pivot pins 104 of the unit 90 can be removed to the back from the channels 73 of the unit installation part 70 (perpendicularly to the axis of holder rotation). By then pulling the unit 90 out to the back, the unit 90 can be removed from the unit installation part 70 (see FIG. 6).

Apart of the conveyance path that opens can thus be used to replace a retard roller 16 that is disposed to the paper supply path 12 near this part of the conveyance path. Because the open part of the conveyance path is used to replace the retard roller, replacing the retard roller is simple. There is also no need to provide space for replacing the retard roller in the part of the conveyance path where the retard roller 16 is located. The size of the printer 1 can therefore be reduced because more space is not needed at the part of the conveyance path where the retard roller 16 is located. Retard roller replacement is further simplified because a large opening can be provided more easily than when space for replacing the retard roller is provided in the outside case of the printer 1. Yet further, because this opening can be covered by a conveyance guide panel, the configuration for opening and closing the opening can be simplified compared with when the opening is provided in the outside case.

The roller holder unit 90 in this example includes first and second holders 100, 110 that are connected to rotate relative to each other around pivot pins 104, and a tension spring 130 disposed in tension between the first and second holders. The engaging plate 123 also has an engaging part 123*a*, and the unit 90 can be installed to and removed from the unit installation part 70 by elastically deforming the engaging part 123*a*. When the unit 90 is installed in the unit installation part 70, the second holder 110 is held stationary, and the first holder 100 can rotate on the axis of holder rotation 100*a*. Furthermore, because the first holder 100 is urged toward the conveyance roller 17 by the tension spring 130, the retard roller 16 supported by the first holder 100 is urged toward the conveyance roller 17.

The unit 90 can thus be easily installed to and removed from the unit installation part 70 by using the engaging part 123*a*. A tension spring 130 that exerts an urging force pushing the retard roller 16 toward the conveyance roller 17 is included in the unit 90. The unit 90 can be easily installed and removed because installing and removing the unit 90 does not require overcoming this urging force. In addition, the urging force of the tension spring 130 holds the engaging pins 105 of the first holder 100 in contact with the engaging surfaces 118*a* of the second holder 110 when the unit 90 is not installed. The first and second holders 100, 110 are thus held together with no play therebetween, and the unit 90 is easier to handled when not installed.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A media conveyance device comprising:

a first media conveyance path that conveys a sheet medium;

a second media conveyance path that conveys the medium and can change to an open state;

a media conveyance roller and a media separation roller disposed in opposition with the first media conveyance path therebetween; and a roller installation unit to which the media separation roller is installed in a state enabling removing and installing the media separation roller from the second media conveyance path side;

a roller holder unit supporting the media separation roller;

wherein the roller holder unit is removably installed in the roller installation unit; and wherein the roller holder unit is pivotally connected to the roller installation unit.

2. The media conveyance device described in claim 1, further comprising:

a device unit; and a reversing unit attached to the device unit removably or pivotably on a predetermined opening and closing axis;

the device unit including a unit-side conveyance path that conveys the medium, a media storage unit that stores the media in a stack, and a media supply path that supplies the media from the media storage unit to the unit-side conveyance path;

the reversing unit including a reversing conveyance path that reverses the front and back of media conveyed from the unit-side conveyance path and returns the media to the unit-side conveyance path;

the media supply path being the first media conveyance path; and part of the reversing conveyance path being the second media conveyance path.

3. A printer comprising:

the media conveyance device described in claim 2; and a print unit that prints on the media conveyed through the unit-side conveyance path of the media conveyance device.

4. A media conveyance device comprising:

a first media conveyance path that conveys a sheet medium;

a second media conveyance path that conveys the medium and can change to an open state;

a media conveyance roller and a media separation roller disposed in opposition with the first media conveyance path therebetween;

a roller installation unit to which the media separation roller is installed in a state enabling removing and installing the media separation roller from the second media conveyance path side; and an opening formed in a media guide surface defining the second media conveyance path; and a media conveyance guide that openably covers the opening;

the media separation roller being removably installed through the opening to the roller installation unit.

5. A media conveyance device comprising:

a first media conveyance path that conveys a sheet medium;

a second media conveyance path that conveys the medium and can change to an open state;

a media conveyance roller and a media separation roller disposed in opposition with the first media conveyance path therebetween;

a roller installation unit to which the media separation roller is installed in a state enabling removing and installing the media separation roller from the second media conveyance path side; and a roller holder unit supporting the media separation roller, the roller holder unit being removably installed in the roller installation unit, and wherein the roller holder unit includes the media separation roller, an urging member that applies pressure on the media separation roller toward the media conveyance roller, and a holder that supports the media separation roller and the urging member;

the roller installation unit including a holder installation unit that removably supports the holder.

6. The media conveyance device described in claim 5, wherein:

the holder of the roller holder unit includes a first holder and a second holder;

the first holder supports the media separation roller;

the second holder is connected to the first holder pivotably on an axis of holder rotation parallel to the axis of rotation of the media separation roller;

the urging member urges the first holder to the second holder in one direction of rotation around the axis of holder rotation;

the holder installation unit of the roller installation unit includes a first holder installation unit and a second holder installation unit;

the first holder installation unit supports the first holder rotatably around the axis of holder rotation and removably from a direction intersecting the axis of rotation of the media separation roller; and the second holder installation unit removably holds the second holder at a specific position of rotation around the axis of holder rotation.

7. The media conveyance device described in claim 6, wherein:

the first holder has an engaging part that engages the second holder from the direction of rotation due to the urging force of the urging member.

8. The media conveyance device described in claim 6, wherein:

the first holder has a support shaft that defines the axis of holder rotation;

the first holder installation unit has a channel that rotatably supports the support shaft, and a channel opening that is formed in the channel and opens in a direction intersecting the axis of rotation of the media separation roller;

the shape of the support shaft in a section perpendicular to the axis is a shape of which one side of the perpendicular direction is a wide part and the other side is a narrow part that is narrower than the wide part; and the width of the channel opening is a width that enables the narrow part of the support shaft to pass through and the wide part to not pass through.

9. The media conveyance device described in claim 6, wherein:

the second holder installation unit has an installation unit-side engaging part;

the second holder has a holder-side engaging part that can engage the installation unit-side engaging part from the opposite direction as the direction of rotation around the axis of holder rotation; and the holder-side engaging part is elastically deformable in the direction releasing engagement with the installation unit-side engaging part.

10. The media conveyance device described in claim 6, wherein:

the first holder has a holder-side contact part; and the holder installation unit has an installation unit-side contact part that contacts the holder-side contact part of the first holder installed in the first holder installation unit, and can rotate the first holder in the opposite direction as the direction of rotation.

* * * * *